US007574843B2

(12) United States Patent
Koster et al.

(10) Patent No.: US 7,574,843 B2
(45) Date of Patent: Aug. 18, 2009

(54) METHOD OF MANUFACTURING AND STACKING PACKAGING UNITS WITH INCREASED STABILITY

(75) Inventors: Christoph Koster, Kleve (DE); Josef Düpper, Bedburg-Hau (DE); Alexander Brüker, Kalkar (DE); Reinhard Wilzeck, Kleve (DE); Michael Jörissen, Bedburg-Hau (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 207 days.

(21) Appl. No.: 11/625,646

(22) Filed: Jan. 22, 2007

(65) Prior Publication Data

US 2007/0169433 A1 Jul. 26, 2007

(30) Foreign Application Priority Data

Jan. 23, 2006 (DE) ..... 10 2006 003 338

(51) Int. Cl.
*B65B 53/00* (2006.01)
*B65B 21/24* (2006.01)

(52) U.S. Cl. ..... 53/398; 53/441; 53/448; 53/475; 53/48.2; 53/556; 53/158; 53/540; 53/543

(58) Field of Classification Search ..... 53/398, 53/48.2, 48.1, 441, 442, 556, 557, 443, 448, 53/158, 531, 539, 540, 543; 206/432, 503; *B65B 53/00, B65B 53/02, 21/24; B65D 71/08*
See application file for complete search history.

(56) References Cited

U.S. PATENT DOCUMENTS

| | | | | |
|---|---|---|---|---|
| 3,353,326 | A | 11/1967 | Becker | |
| 3,391,814 | A * | 7/1968 | Box | 206/503 |
| 3,650,394 | A | 3/1972 | De Cazenove | |
| 3,740,238 | A * | 6/1973 | Graham | 206/503 |
| 4,162,738 | A * | 7/1979 | Wright | 206/503 |
| 5,038,961 | A * | 8/1991 | Watanabe et al. | 206/503 |
| 5,938,011 | A * | 8/1999 | Holzapfel et al. | 53/398 |
| 6,834,481 | B1 | 12/2004 | Huang | |

FOREIGN PATENT DOCUMENTS

| | | | |
|---|---|---|---|
| DE | 3439698 | A1 | 4/1986 |
| DE | 4225550 | A1 * | 2/1994 |
| DE | 29603307 | U1 * | 7/1998 |
| EP | 1344721 | A1 * | 9/2003 |
| FR | 2297782 | A1 * | 8/1976 |
| GB | 2353276 | A1 | 2/2001 |
| WO | WO 96/28362 | A1 | 9/1996 |
| WO | WO 9959873 | A1 * | 11/1999 |

* cited by examiner

*Primary Examiner*—Stephen F Gerrity
(74) *Attorney, Agent, or Firm*—Nils H. Ljungman & Associates

(57) ABSTRACT

A beverage bottling plant for filling beverage bottles with a liquid beverage material with a packing apparatus for packing filled bottles and a method of operation thereof. Further, a method of manufacturing and stacking packaging units with increased stability is performed.

7 Claims, 10 Drawing Sheets

METHOD OF MANUFACTURING AND STACKING PACKAGING UNITS WITH INCREASED STABILITY

BACKGROUND

1. Technical Field

This application relates to a beverage bottling plant for filling beverage bottles with a liquid beverage material with packing apparatus for packing filled bottles and a method of operation thereof.

2. Background Information

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

There are some bottle-like containers, among other vessels for holding liquids, that have, on a container bottom that is opposite a container mouth, an indentation or depression in a shape such that the container bottom is concavely arched on the external surface of the bottom of the container or vessel. Containers of this type are commonly known in 5 or 10 liter sizes, and can be used, for example, as water containers for mineral water or table water, and can be held or fastened with their mouth in a water dispenser for use.

As a rule, these containers and other vessels are combined or essentially combined into packaging units or bundles for transport and/or storage and/or sale, and in the form of what are generally called multi-packs, in which a plurality of containers are combined into bundles and shrink-wrapped in a single film of shrink wrap, which bundles are also generally called trays, in which a plurality of containers, including some that are not wrapped in film, are located on a piece of cardboard that has upright or essentially upright corners or wall areas, which are also called shrinktrays, in which a plurality of containers are located on a tray-like cardboard tray, where they are secured in place by shrink wrap, or in the form of shrinkpads, in which a plurality of containers are secured in position by shrink wrap on an essentially flat cardboard tray.

One possible disadvantage with these packaging units, and with the shrinktrays and/or shrinkpads mentioned above, is that a stable or at least a completely stable stacking of these packaging units is not possible or at least not always possible, e.g. on palettes for transport and/or storage, especially in high stacks of packaging units. On the contrary, when the packaging units of the type mentioned above are set on top of one another, the resulting stacks are very unstable or at least not very stable.

OBJECT OR OBJECTS

At least one object of at least one possible embodiment of the present application is to describe a bundle which eliminates the disadvantages cited above.

SUMMARY

At least one possible embodiment of the present application may be a bundle or packaging unit consisting of at least two bottle-type containers which are oriented upright or essentially upright with their container bottom which is concave or essentially concave on the outside standing upright or essentially upright on a tray, and are essentially secured on this tray by shrunk shrink wrap, wherein a tray opening is provided in the tray in the vicinity of each container such that each container is generally located at a tray opening stand with its container bottom on an area of the tray that surrounds the tray opening, and that in at least two packaging units that are located one on top of the other in a stack of packaging units, the containers of a lower packaging unit each extend with their upper container area through one of the tray openings of the packaging unit above into an open space that is formed by the concave container bottom of a container located on the upper tray. Another possible embodiment of the present application is a method and a device for the creation of bundles, wherein a packaging length of shrink wrap provided with film openings from a strip-format shrink wrap film material, for example, can be wrapped around the underside of the tray provided with the tray openings and the containers that are located on this tray, such that the film openings overlap or approximately overlap with the tray openings and/or the container mouths, and that then the film material is shrunk to form the shrink wrap that surrounds the tray and the containers. A further possible embodiment of the present application is a device for the manufacture of packaging units with a packaging station for the application of the shrink wrap material or of a shrink wrap packaging length to the respective tray provided with the containers and the tray openings, to which packaging station the shrink wrap material is possibly fed from a storage roll, wherein the packaging station is preceded in a feed direction of the shrink wrap material by a perforation station for the introduction of the film openings in the strip-format shrink wrap material pulled off the supply roller.

As a result of a bundle realization in at least one possible embodiment of the present application, it is possible to arrange multiple packaging units into a stack of packaging units one on top of another, so that the containers of the lower packaging unit of each two bundles arranged one on top of the other in a stack extend or essentially extend with their upper container segments through the tray openings of the bundle on top into a space in the upper packaging unit, the space of which is formed or essentially formed by the convex container bottoms of the container lying above or placed above the respective containers in the stack. This arrangement yields a plurality of advantages.

As a result of this mating or interlocking relationship of the packaging units, the stability of the stack of packaging units is increased as a result of the fact that it prevents or essentially prevents the lateral slippage of the individual packaging units in the stack of packaging units or at least makes such slippage more difficult.

As a result of at least one possible configuration of the packaging units and/or by the possible interlocking of the bundles, the height of the stack of packaging units is reduced or essentially reduced, which further contributes to the stability of the stack of packaging units and/or makes it possible with a specified maximum height of the stack of packaging units to possibly increase the number of packaging units in the stack.

As a result of the interlocking of the packaging units, the containers are protected or essentially protected from damage in the vicinity of their neck and mouth.

With an appropriate or desired realization of the tray openings in terms of size and/or shape, it is also possible to create conditions in which the forces of gravity in the stack of packaging units are not exerted or essentially not exerted on the mouths of the containers or the closures that are located on the mouths of the containers but, for example, possibly on the shoulder area that is adjacent or essentially adjacent the mouth of each container and widens toward the bottom of the container and/or possibly on a flange or even a collar that is provided on the container, as a result of which the load or the risk of damage to individual containers in the stack of packaging units is reduced or essentially reduced.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is explained in greater detail below on the basis of one exemplary embodiment that is illustrated in the accompanying figures. In the drawings.

DESCRIPTION OF EMBODIMENT OR EMBODIMENTS

Figure 1:
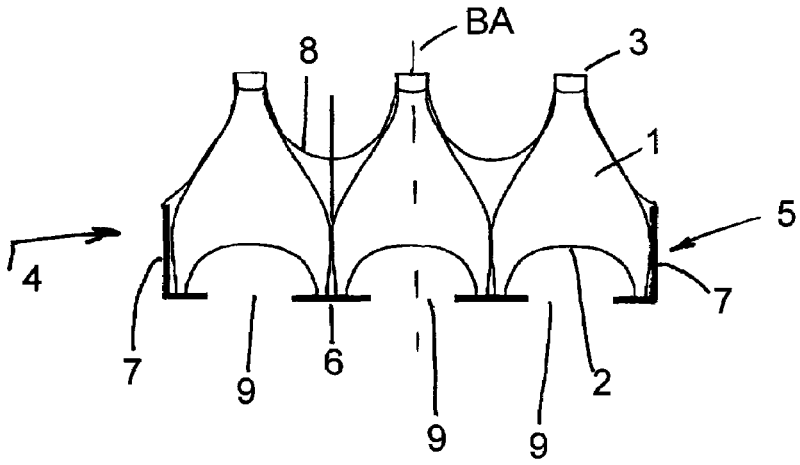
FIG. 1 is a schematic illustration in a side view of a packaging unit or bundle as described in at least one possible embodiment of the present application.
Figure 1B:
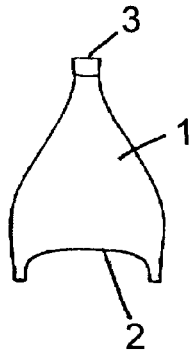
FIG. 1B is a single container in the form of a bottle.
Figure 1A:
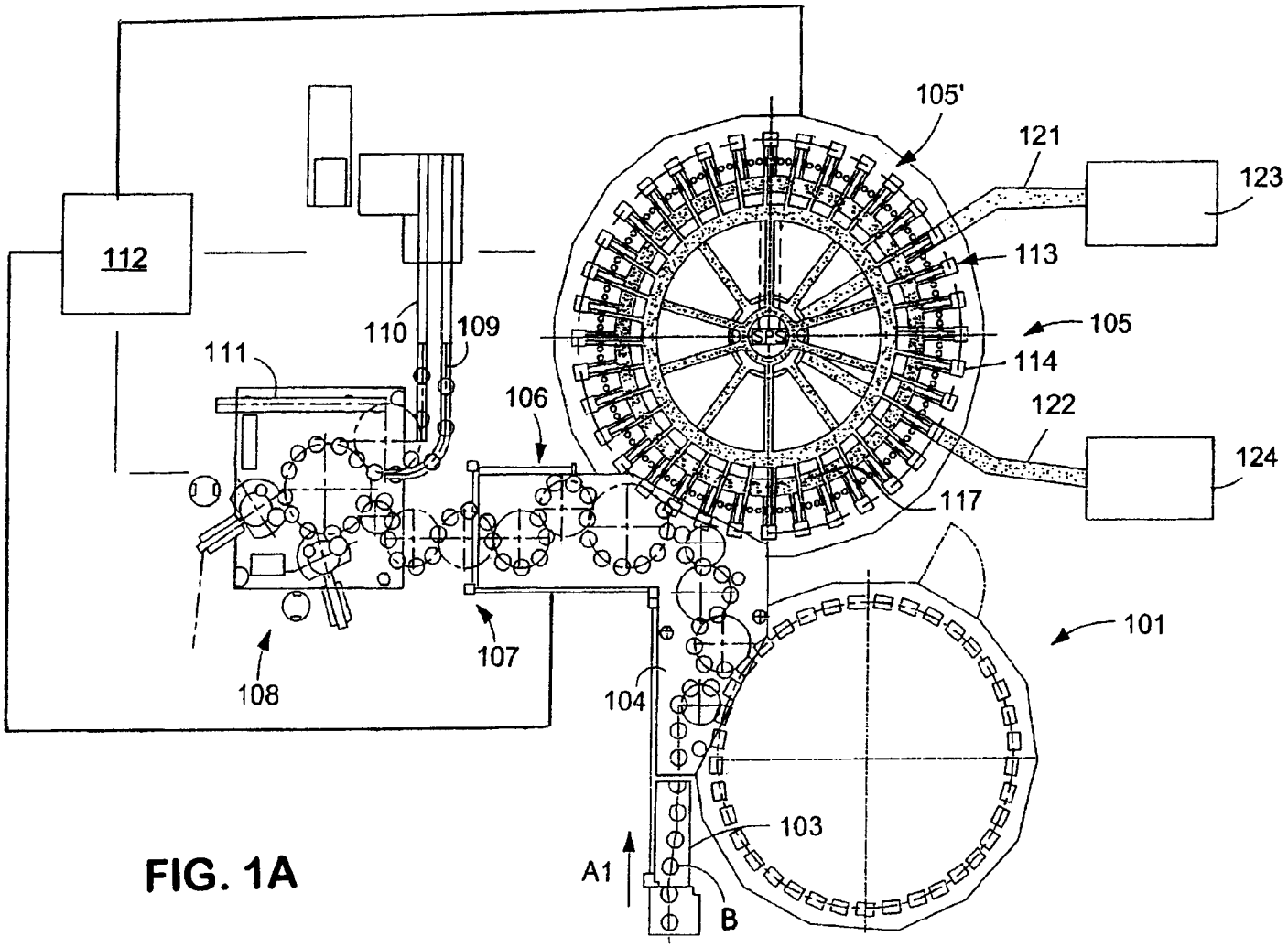
FIG. 1A shows schematically the main components of one possible embodiment example of what may be a typical system for filling containers.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In the figures, reference numeral 1 indicates containers, such as bottle-like containers with a wide belly made of a suitable plastic, for example of PET, which have a sharp or somewhat sharp concave arch on the underside of their bottom 2. Containers of this type are used commonly, for example, as water containers with a volume of five or ten liters. It is possible that in other embodiments the containers 1 may be used to hold other liquids or nearly liquid materials or possibly even other types of materials. It is also possible that in other embodiment examples the containers 1 could possibly be of a somewhat smaller or even somewhat larger volume capacity.

Figure 3:
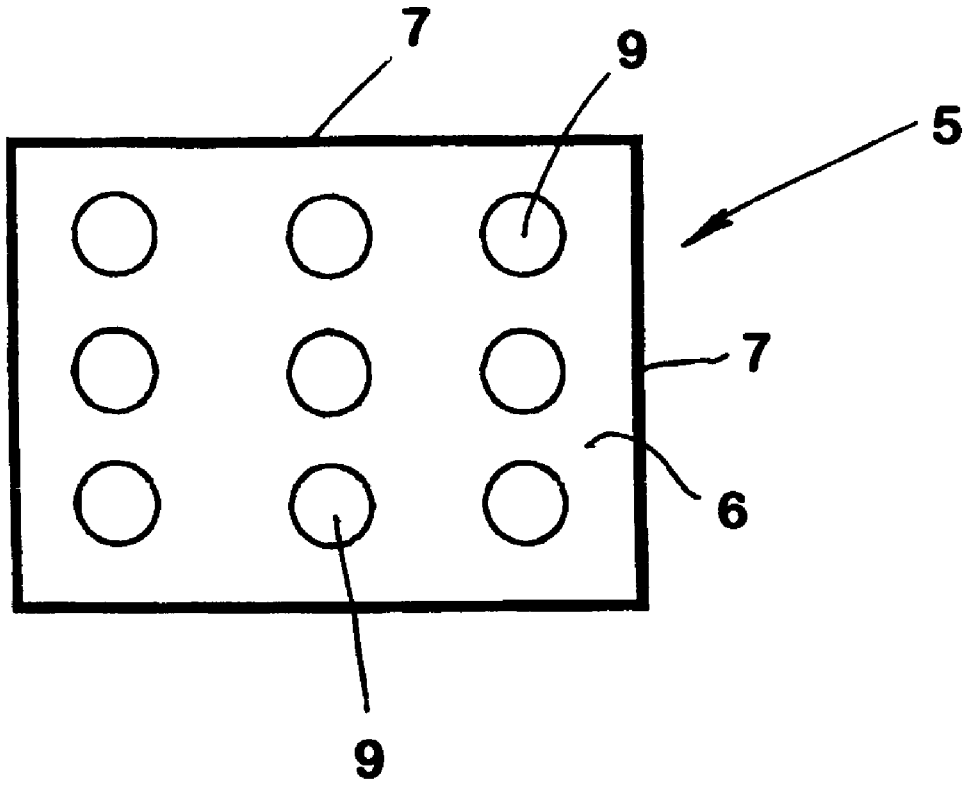
FIG. 3 is a plan view of the bottom of a tray of the packaging unit illustrated in FIG. 1.

FIG. 1B shows a single container in the form of a bottle. A plurality of containers 1, i.e. in the illustrated exemplary embodiment a total of nine containers 1, are combined into a packaging unit 4 as shown in FIG. 1, with their container bottoms 2 on a tray 5 or standing in three rows on the bottom 6 of this tray 5 parallel or essentially parallel to the longitudinal sides of the tray 5, which is rectangular in the plan view, shown in FIG. 3, and with three containers 1 arranged in each row. The containers 1 are oriented with their container axis BA perpendicular or essentially perpendicular to the plane of the tray bottom 6.

The tray 5, which comprises, for example, of single-ply or multiple-ply cardboard, is realized in the illustrated in the embodiment in the form of a pan-shaped or substantially pan-shaped tray with an encircling tray edge 7 that projects above or essentially above the tray base 6, above which edge 7 the containers 1 project upward or essentially upward. In at least one possible embodiment, the packaging unit 4 also is also covered by shrink-wrapped film 8, which tightly encloses or substantially tightly encloses the tray 5 on the underside of its tray bottom 6 and outside on the tray edge 7 and also surrounds or essentially surrounds the containers 1 in their area that projects above the tray 5, including in the vicinity of their container mouths 3, and thus holds or essentially holds the packaging unit together. To this extent, the packaging unit 4 is the same or essentially the same as packaging units of other commonly known methods.

One feature of the packaging unit 4 is that a tray opening 9, which in the illustrated embodiment is circular or essentially circular, is introduced into the tray bottom 6 for each container 1 and is equi-axial or approximately equi-axial with its container axis BA. In at least one possible embodiment, the tray bottom has a total of nine such tray openings 9, which in turn are provided in three rows parallel or substantially parallel to the longer sides of the tray 5 and each with three tray openings 9 in each row.

Figure 4:
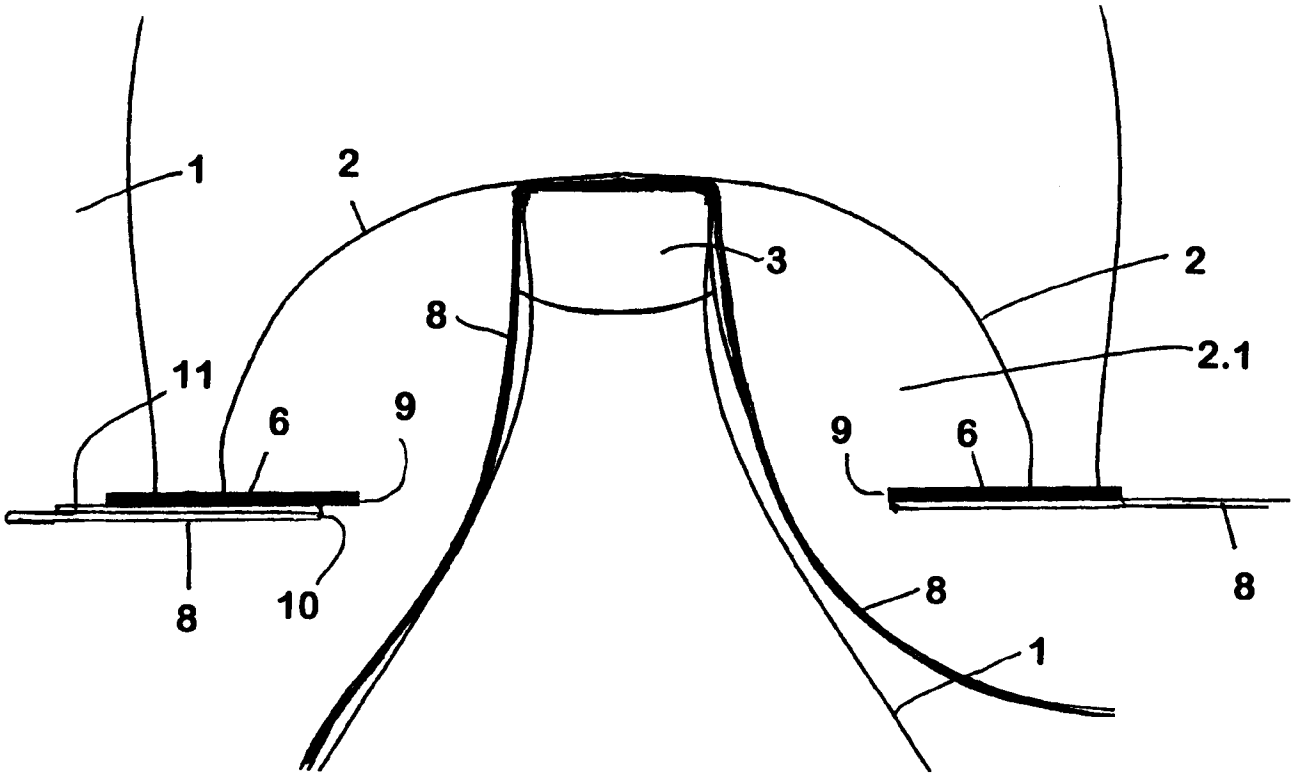
FIGS. 4 and 5 show enlarged details of the stack illustrated in FIG. 2 in two different exemplary embodiments.
Figure 5:
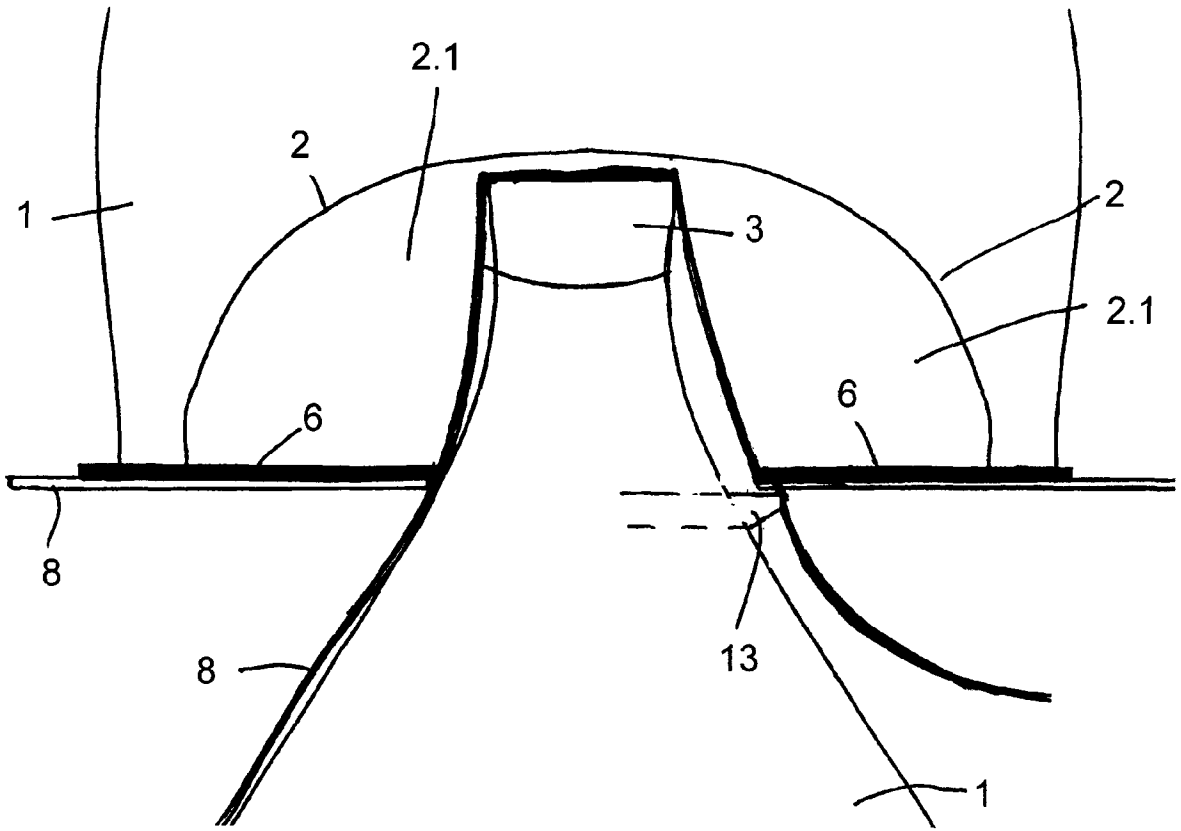
Figure 6:
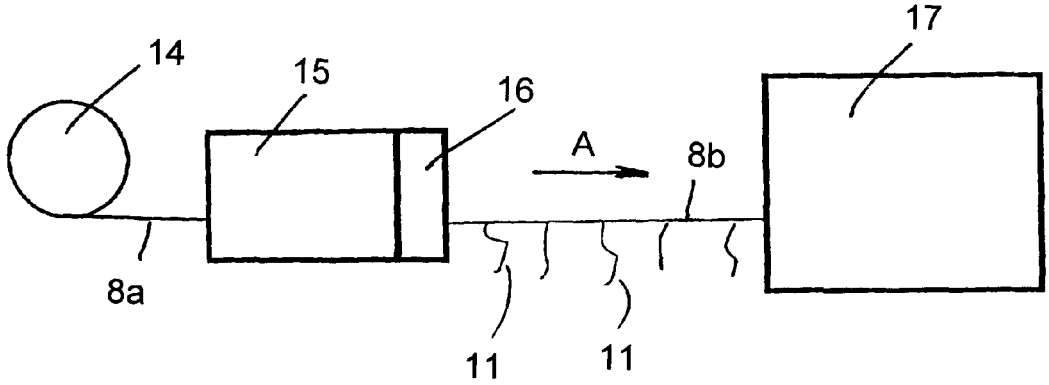
FIGS. 6 and 7 is a schematic illustration of the functional elements of a device for the creation of the packaging unit illustrated in FIG. 1, in a side view and in an overhead view.

Another feature of the packaging unit 4 is that the tray openings 9 are left open or substantially open by the shrink-wrap film 8, as is illustrated clearly in FIGS. 4 and 5. In at least one possible embodiment, these openings 9 are kept free or relatively free because, before the wrapping of the respective tray 5 and the containers 1 inserted in this tray with this material and the shrink wrap 8 or the strip-format shrink-wrap film material 8*a*, shown in FIGS. 6-8, the shrink wrap 8 is perforated before the shrinking at the appropriate intervals, i.e. it is provided with a plurality of film openings 10. The introduction of the film openings 10 in the strip-format shrink wrap film material 8*a* can be done in a wide variety of ways, for example by cutting or punching the film using a corresponding cutting or punching device, by laser cutting etc. The film openings 10 can also be introduced in a wide variety of ways, for example by cutting out the respective film opening 10 completely and/or by cutting it out only partially, so that in the vicinity of the respective film opening 10 there remains a flap-like film residue 11 that creates this opening, as illustrated in FIGS. 4 and 6, whereby the film residue 11 is shown only in an abbreviated fashion in FIG. 4. This type of introduction of the film openings 10 has the advantage or possible advantage that in the device used for the introduction of the film openings 10, there is no or essentially no loose material or film residue, and there is not even any or essentially not any risk that such film residues will cause damage in a plant or apparatus for the manufacture of the packaging units 4.

If the film openings 10 are cut out completely or substantially completely, in at least one possible embodiment, the film residues that are created are removed in a suitable fashion, for example by suction, with the use of a suitable conveyor element, such as a conveyor belt, for example.

Figure 2:
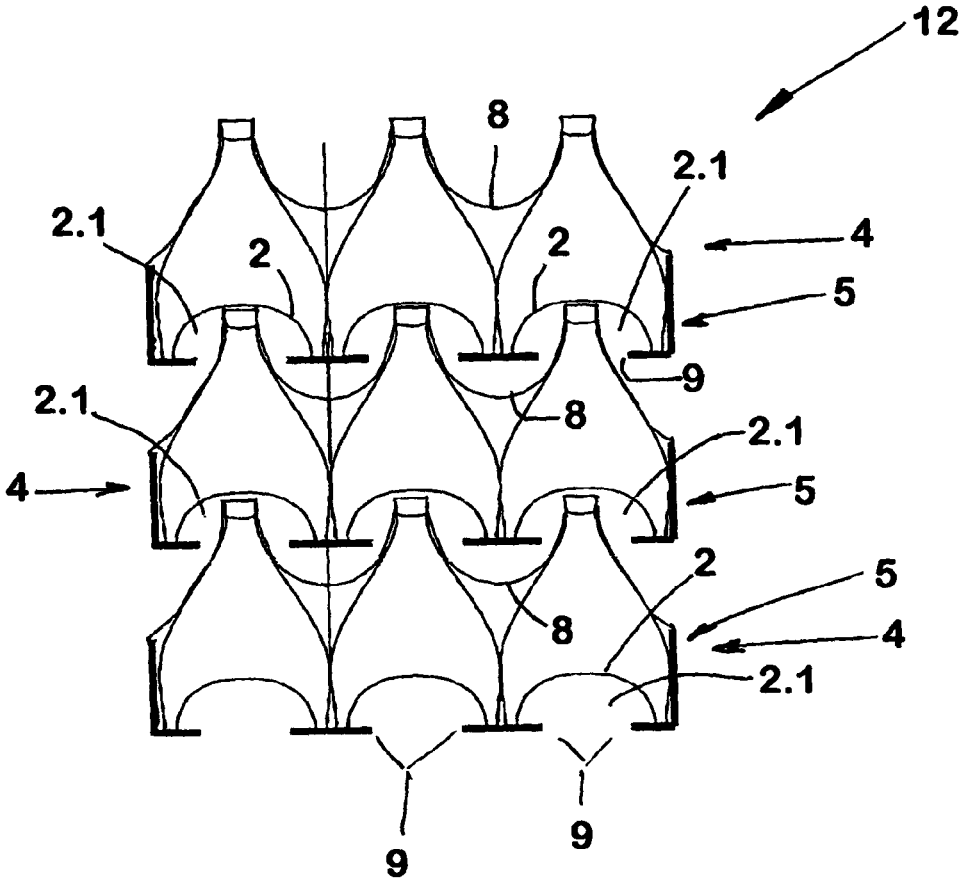
FIG. 2 shows a stack of packaging units formed by a plurality of packaging units stacked one on top of another.

As FIGS. 2 and 4 show, in at least one possible embodiment the described realization of the packaging unit 4 has the advantage or relative advantage, among other things, that a plurality of such packaging units 4 can be stacked one on top of another into a packaging unit stack 12, whereby with the exception of the uppermost packaging unit 4, in this stack 12 of packaging units 4, the containers of each packaging unit 4 extend or essentially extend with their upper container segment that has the container mouth 3 through the openings 9 and 10 into the open spaces 2.1 of the packaging unit 4 above, which are formed by the concavely arched container bottoms 2 of the respective containers 1 located above, which results in a packaging unit that is stable for transport and/or storage and/or individual sale, and which is then conventionally located on a palette (not shown).

With the exception of the container 1 of the uppermost packaging unit 4, the containers 1 lie with the container mouths 3 each against or essentially against the container bottom 2 of a container 1 above in the stack 12 of packaging units. Basically, however, it is also possible, by an appropriate adjustment at least of the tray openings 9 to ensure or substantially ensure that the trays 5 (with the exception of the bottommost tray 5) in the stack 12 of packaging units 12 are supported or essentially supported with the edge of the tray openings 9 each on the expanding area of the container 1 or the body area of the containers, so that each of the container mouths is at a distance from the container bottom of the container 1 lying above it in the stack 12 of packaging units and is thus relieved or somewhat relieved of some of the forces exerted on it. This situation is illustrated on the left in FIG. 5. As shown in the right in FIG. 5, it is also possible, among other things, to relieve or substantially relieve the forces exerted on the container mouths by providing the containers 1 with a radially or essentially radially projecting edge or flange 13 in an upper area of the container, for example in the vicinity of their container mouth 3, which edge or flange is then used to contact or support the tray 5 that lies above it in the stack 12 of packaging units on the edge of the individual tray opening 9.

However, it is also possible to relieve or essentially relieve the load on the container mouths 3 by supporting or substantially supporting the containers 1 on a shoulder or head area of the container that runs essentially horizontally, whereby this support can be applied, for example, over almost or essentially almost the entire surface. Only the mouth area is thereby spared from the load by the supporting container 1.

Figure 7:
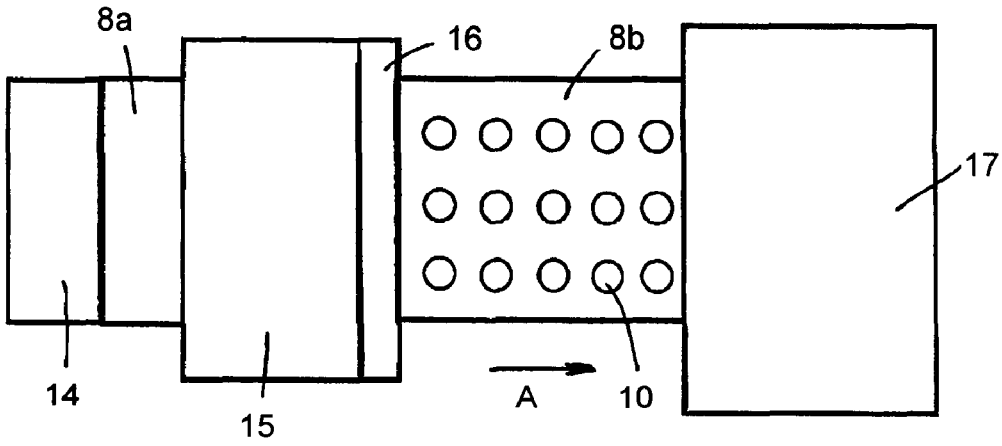

FIGS. 6 and 7 show schematically the functional elements of a machine or a device for the manufacture of the packaging units 4. In at least one possible embodiment of the present application, the strip-format film material 8*a* is pulled off a storage roll 14 in a transport direction A and is perforated or punched at the specified intervals in a perforation station 15, i.e. the film openings 10 are cut out only partially, or essentially only partially, so that in the manner described above, the flap-like film residues 11 that are produced during the cutting remain on the strip-format film material 8*a*.

Then the strip-format film material is fed to a cutting station 16, in which the shrink wrap packaging length 8*b* required for the shrink wrap 8 is cut off to the appropriate length and with the appropriate positioning with reference to the film openings 10. The shrink-wrap packaging length 8*b* is then fed to the actual packaging station 17 for the wrapping of the respective tray 5 with the containers 1 during the wrapping process and is shrink-fitted over the tray 5 and the containers 1 by heating.

In the packaging machine 17, appropriate means are applied to ensure or substantially ensure that during the wrapping, the perforated or punched shrink-wrap film packaging length 8*b* is fed at the appropriate or desired intervals and is introduced under the tray bottom 6 so that each film opening 10 overlaps at least approximately with a tray opening 9. The packaging machine 17 also ensures, or essentially ensures, by appropriate means, for example possibly by mechanical transfer devices and/or an air current, that when the tray and containers 1 are wrapped with the perforated shrink wrap packaging length 8*b*, the film residues 11 are reliably or substantially reliably located to the side of the respective opening 9 or 10. As a result of the relocation of the film residues 11 in at least one possible embodiment of the present application, these residues are therefore moved to a non-critical or substantially non-critical location of the respective packaging unit 4, where they are reduced in size to an appropriate or desired extent by the shrinking process and/or are made to adhere or substantially adhere to the adjacent film in this non-critical location during the shrinking process, so that the tray openings 9 and 10 are reliably kept free of the film residues 11.

Figure 8:
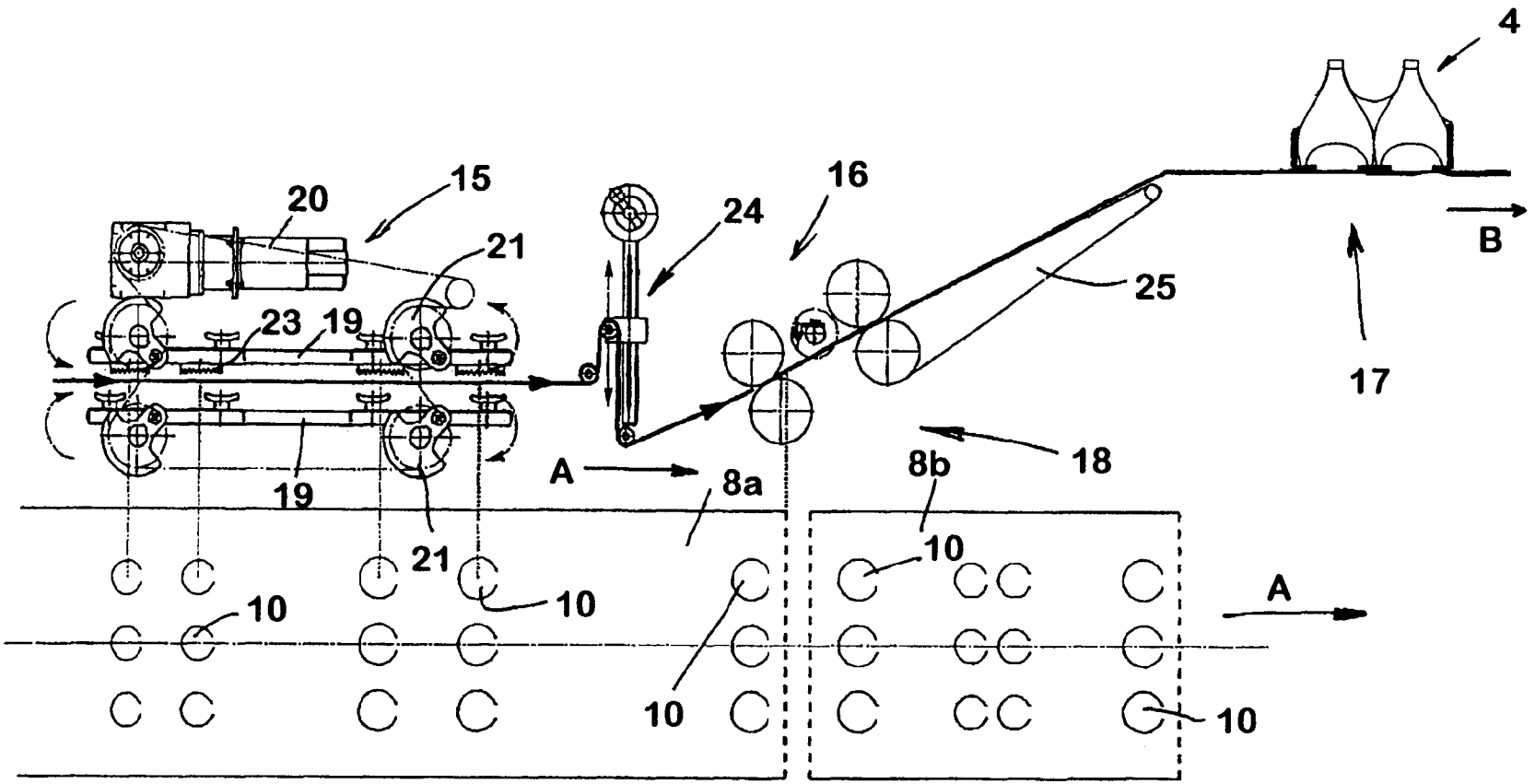
FIG. 8 is a side view showing a detailed illustration of a shrink film perforation and feed unit, together with a strip-shaped shrink wrap material and with a shrink wrap packaging length separated from this material.

FIG. 8 shows in greater detail the perforation and feed unit 18 that contains the perforation station 15 and the cutting station 16, together with the strip-format film material 8*a* and the shrink wrap packaging length 8*b* that has been cut off from this film material.

The perforation station 15 in this embodiment comprises two plate-shaped tool carriers 19 which are oriented parallel or substantially parallel to each other, and between which a tool gap is formed, through which the strip-format film material 8*a* is guided. By means of a drive system consisting of a drive motor 20 and a plurality of cams 21 that are driven by it, the two tool trays 19 are driven in an oscillating and circular, so that in the course of this motion the tool carriers 19 come closer or somewhat closer to each other, and then in their position adjacent or substantially adjacent each other are moved in a work stroke parallel or substantially parallel to each other and in the transport direction A of the film material 8*a*, then again apart from each other and then move in a backward stroke farther apart from each other opposite or essentially opposite to the transport direction A of the film material 8*a*. On their sides facing each other, the tool carriers 19 are provided with corresponding tools 23 that effect the cutting of the film openings 10 in at least one possible embodiment of the present application.

In at least one possible embodiment, in the transport direction A, this perforation station 15 is followed by the cutting station 16, in which the respective shrink wrap film packaging length 8*b* is cut off the perforated film material 8*a*. To thereby achieve the properly or appropriately spaced location of the film openings 10 in the longitudinal direction of the strip, upstream of the cutting station 16 there is a repeat adjustment mechanism 24, with which the individual length of the strip-format film material 8*a* between the perforation station 15 and the cutting station 16 can be set so that the separation of the shrink-wrap packaging length 8*b* is accomplished with high or relatively high repeating accuracy with reference to the film openings 10. By means of a conveyor line 25 that is downstream of the cutting station 16, the shrink wrap packaging lengths 8*b* are fed to the packaging machine 17, from which the finished packaging units 4 are then transported away in the direction indicated by the arrow B in FIG. 8, according to at least one possible embodiment.

At least one possible embodiment of the present application also teaches that the shrink wrap 8 is provided with film openings 10 not only in the vicinity of the tray openings 9. Rather, the shrink wrap 8 is also to be provided with film openings 10 in the vicinity or general vicinity of the container mouths 3, so that the container mouth 3, when it is inserted into the concave container bottom 2, does not encounter any or essentially any interference from the tightly stretched, shrunk shrink wrap 8.

In at least one possible embodiment of the present application, a packaging arrangement may comprise a shaping and/or pressing apparatus for forming a shrink wrap packaging length 8*b* into a predetermined shape and/or fit over and around the trays 5 and containers 1, resulting in a packaging unit 4. A shaping and/or pressing apparatus can comprise a metal or other heat-conducting material, which may be located in a packaging arrangement or other appropriate location with respect to a packaging machine. It is possible that a shaping and/or pressing apparatus can have an upper portion, designed to hold the packaging length of shrink wrap down and over and in between the container mouths 3, and a lower portion, with heads designed to hold the shrink wrap up and into the concave area of the container bottoms 2.

Figure 9:
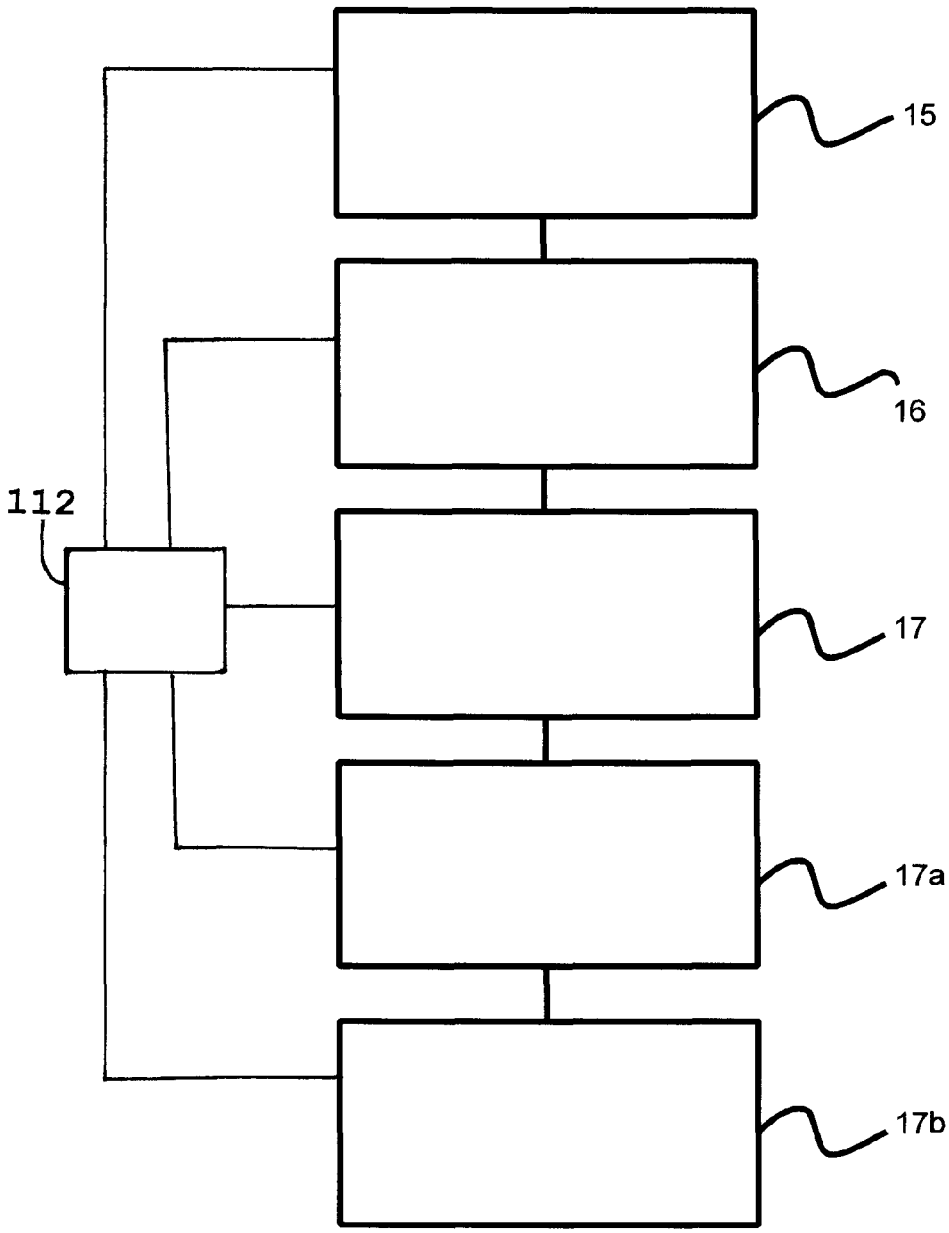
FIG. 9 is a block diagram which shows an additional possible variation of the arrangement of some of the components shown in FIG. 8.

FIG. 9 is a block diagram, according to at least one possible embodiment of the present application, in which a packaging arrangement comprises a shaping and pressing apparatus 17*a* and a heated shrink tunnel 17*b* following a packaging machine 17. In at least one possible embodiment, shrink-wrap film 8 travels to the perforation station 15, the cutting station 16, and then to the packaging station 17, where the packaging unit 4 may be wrapped with the shrink wrap packaging length 8*b*. The shrink wrap packaging length 8*b* may then be shaped around and pressed onto the packaging unit 4 by the shaping and pressing apparatus 17*a*, before entering the heated shrink tunnel 17*b*. The shaping and pressing apparatus 17*a* may comprise a metal and/or other heat-conducting material with an upper portion, designed to hold the shrink wrap packaging length 8*b* down over and in between the container mouths 3, and with a lower portion having heads designed to hold the shrink wrap packaging length 8*b* up and into the concave area of the container bottoms 2. After the shrink film has been shrink-fitted over the packaging unit 4, and the film has cooled, the shaping and pressing apparatus 17*a* may be released from the shaping and pressing position. In at least one possible embodiment, the components described herein can be controlled by a central control arrangement 112, which could be, for example, computerized control system that monitors and controls the operation of the various stations and mechanisms of the beverage bottling plant.

At least one possible embodiment of the present application also teaches, with regard to the removal of the film residue 11, not only their complete or essentially complete removal and/or leaving them completely or essentially completely in place, but also that any or many desired combinations of leaving the residue in place or removing it may be used. For example, it is advantageous or somewhat advantageous to remove the film residue 11 in the vicinity of the container mouth 3, because in this area the presence of film residue 11 can sometimes result in unattractive adhering bits of shrink wrap that offend the consumer's aesthetic sensibilities.

It goes without saying that the cutting or punching-out of the strip-format film material 8*a* can be done using any or many other common and/or known methods that are appropriate to this application, without thereby going beyond the teaching of at least one possible embodiment of the present application.

At least one possible embodiment of the present application is described herein and above on the basis of one exemplary embodiment. It goes without saying that numerous modifications and variants are possible without thereby going beyond the teaching of at least one possible embodiment of a method and at least one possible embodiment of a device of the present application described herein.

At least one possible embodiment of the present application can be used for numerous other containers and/or items with a bottom portion that is opposite a top portion, having an indentation or depression or even a recessed area on the external surface of the bottom portion opposite a top or mouth portion that is smaller and/or is shaped in such a manner as to mate with and/or fit into the bottom portion, thus allowing for stacking of such items. In other possible embodiments of the present application, containers and/or other items may have a bottom with a center portion somewhat higher than several protruding portions that act as a supportive base in the peripheral area of the bottom, when the bottle is oriented in an upright position. One example of such a container may be a two-liter bottle.

At least one possible embodiment of the present application relates to a packaging unit or bundle comprising at least two bottle-type containers which are oriented upright or relatively upright with their container bottom which is concave on the outside standing upright on a tray, and are secured on this tray by shrunk shrink wrap. At least one possible embodiment of the present application further relates to a method for the manufacture of a packaging unit and a device for the manufacture of such a packaging unit, with a packaging station for the application of the shrink wrap material or of a shrink wrap packaging length to a respective tray provided with the containers and the tray openings, to which packaging station the shrink wrap material is fed from a storage roll.

Developments of other possible embodiments of the present application are described herein.

One feature or aspect of an embodiment is believed at the time of the filing of this patent application to possibly reside broadly in a packaging unit consisting of at least two bottle-type containers 1 which are oriented upright with their container bottom 2 which is concave on the outside standing upright on a tray 5, and are secured on this tray 5 by shrunk shrink wrap 8, characterized in that a tray opening 9 is provided in the tray 5 in the vicinity of each container 1 such that each container 1 located at a tray opening 9 stand with its container bottom 2 on an area of the tray that surrounds the tray opening 9, and that in at least two packaging units 4 that are located one on top of the other in a stack 12 of packaging units, the containers 1 of a lower packaging unit 4 each extend with their upper container area 3 through one of the tray openings 9 of the packaging unit 4 above into an open space 2.1 that is formed by the concave container bottom 2 of a container 1 located on the upper tray.

Another feature or aspect of an embodiment is believed at the time of the filing of this patent application to possibly reside broadly in the packaging unit, characterized in that the containers 1 are arranged on the tray 5 in a plurality of rows, and each row has a plurality of containers 1.

Yet another feature or aspect of an embodiment is believed at the time of the filing of this patent application to possibly reside broadly in the packaging unit, characterized in that the containers 1 are arranged on the tray 5 in three rows of three containers 1 each.

Still another feature or aspect of an embodiment is believed at the time of the filing of this patent application to possibly reside broadly in the packaging unit, characterized in that the individual tray 5 is likewise wrapped by the shrunk shrink wrap, and that the shrunk shrink wrap 8 has film openings 1 that overlap or nearly overlap with the tray openings 9 and/or the container mouths 3.

A further feature or aspect of an embodiment is believed at the time of the filing of this patent application to possibly reside broadly in the packaging unit, characterized in that the film openings 1 are introduced by cutting them out completely.

Another feature or aspect of an embodiment is believed at the time of the filing of this patent application to possibly reside broadly in the packaging unit, characterized in that the film openings 10 are introduced by cutting them out only partly.

Yet another feature or aspect of an embodiment is believed at the time of the filing of this patent application to possibly reside broadly in the packaging unit, characterized in that the film residue 11 that is formed during the partial cutting out or punching of the film openings 10 remains adhering to the film, to the side of the tray opening 9.

Still another feature or aspect of an embodiment is believed at the time of the filing of this patent application to possibly reside broadly in the packaging unit, characterized in that the tray openings 9 are realized in terms of shape and/or size so that in a stack 12 of packaging units that comprises of at least two packaging units 4, the containers 1 of a lower packaging unit are each in contact with the upper packaging unit, by means of an area of the container that extends through a tray opening 9, for example with the container mouth 3 against a container bottom 2 of a container 1 of the packaging unit 4 above it.

A further feature or aspect of an embodiment is believed at the time of the filing of this patent application to possibly reside broadly in the packaging unit, characterized in that the tray openings 9 are realized in terms of shape and/or size so that in a stack 12 of packaging units that comprises of at least two packaging units 4, the tray 5 of an upper packaging unit 4 is supported in the vicinity of its tray openings 9 and/or with the tray bottom 6 on the containers 1 of the packaging unit 4 underneath it.

Another feature or aspect of an embodiment is believed at the time of the filing of this patent application to possibly reside broadly in the packaging unit, characterized in that the trays 5 are each realized in the shape of a plate.

Yet another feature or aspect of an embodiment is believed at the time of the filing of this patent application to possibly reside broadly in the packaging unit, characterized in that the trays are each realized with a tray bottom 6 that has the tray openings 9 and with a tray edge 7 that projects above the tray bottom.

Still another feature or aspect of an embodiment is believed at the time of the filing of this patent application to possibly reside broadly in the packaging unit, characterized in that at least two packaging units 4 are arranged one above the other to form a stack 12.

A further feature or aspect of an embodiment is believed at the time of the filing of this patent application to possibly reside broadly in a method for the manufacture of a packaging unit, characterized in that a packaging length **8*b* of shrink wrap provided with film openings 11 from a strip-format shrink wrap film material 8*a*, for example, is wrapped around the underside of the tray 5 provided with the tray openings 9 and the containers 1 that are located on this tray, such that the film openings 10 overlap or approximately overlap with the tray openings 9 and/or the container mouths 3, and that then the film material is shrunk to form the shrink wrap 8 that surrounds the tray 5 and the containers 1**.

Another feature or aspect of an embodiment is believed at the time of the filing of this patent application to possibly reside broadly in the method for the manufacture of a packaging unit, characterized in that for the formation of the shrink wrap packaging length **8*b* provided with the film openings 10, the strip-format film material 8*a* is provided with these film openings 10 by punching or cutting, and that then the respective shrink wrap packaging length 8*b* is cut off this film material 8*a***.

Yet another feature or aspect of an embodiment is believed at the time of the filing of this patent application to possibly reside broadly in the method for the manufacture of a packaging unit, characterized in that the film openings 10 are produced by cutting or punching with a cutting or punching tool.

Still another feature or aspect of an embodiment is believed at the time of the filing of this patent application to possibly reside broadly in the method for the manufacture of a packaging unit, characterized in that the film openings 10 are produced by laser cutting.

A further feature or aspect of an embodiment is believed at the time of the filing of this patent application to possibly reside broadly in the method for the manufacture of a packaging unit, characterized in that the film openings 10 are cut out or punched out completely.

Another feature or aspect of an embodiment is believed at the time of the filing of this patent application to possibly reside broadly in the method for the manufacture of a packaging unit, characterized in that the film openings 10 are cut out or punched only partly, and that the film residue 11 that is created during the cutting or punching remains adhering to the film material **8*a***.

Yet another feature or aspect of an embodiment is believed at the time of the filing of this patent application to possibly reside broadly in the method for the manufacture of a packaging unit, characterized in that before the shrinking process of the film material **8*a* or of the shrink wrap packing length 8*b*, the film residue 11 is oriented so that it is located to one side of the respective film opening 10 and tray opening 9**.

Still another feature or aspect of an embodiment is believed at the time of the filing of this patent application to possibly reside broadly in the method for the manufacture of a packaging unit, characterized in that the relocation is effected mechanically, for example by relocation means or guide surfaces and/or by an air current.

A further feature or aspect of an embodiment is believed at the time of the filing of this patent application to possibly reside broadly in a device for the manufacture of packaging units with a packaging station 17 for the application of the shrink wrap material or of a shrink wrap packaging length 8*b* to the respective tray 5 provided with the containers 1 and the tray openings 9, to which packaging station the shrink wrap material 8*a*, 8*b* is fed from a storage roll 14, characterized in that the packaging station 19 is preceded in a feed direction A of the shrink wrap material 8*a*, 8*b* by a perforation station 15 for the introduction of the film openings 10 in the strip-format shrink wrap material 8*a* pulled off the supply roller 14.

Another feature or aspect of an embodiment is believed at the time of the filing of this patent application to possibly reside broadly in the device, characterized in that downstream of the perforation station 15 in the transport direction A of the shrink wrap material 8*a* is a cutting station 16 for the separation of the respective shrink wrap packing length 8*b*.

Yet another feature or aspect of an embodiment is believed at the time of the filing of this patent application to possibly reside broadly in the device, characterized in that a repeat adjustment mechanism 24 is provided between the perforation station 15 and the cutting station 16.

Still another feature of aspect of an embodiment is believed at the time of the filing of this patent application to possibly reside broadly in the device, wherein A beverage bottling plant for filling beverage bottles with liquid beverage material, said beverage bottling plant comprising: a rotary beverage bottle filling machine being configured and disposed to fill beverage bottles with liquid beverage material; a first conveyor arrangement being configured and disposed to convey beverage bottles to be filled to said beverage bottle filling machine; said beverage bottle filling machine comprising: a rotor; a rotatable vertical machine column; said rotor being connected to said vertical machine column to permit rotation of said rotor about said vertical machine column; a plurality of beverage bottle filling elements for filling beverage bottles with liquid beverage material being disposed on the periphery of said rotor; each of said plurality of beverage bottle filling elements comprising a container carrier being configured and disposed to receive and hold beverage bottles to be filled; each of said plurality of beverage bottle filling elements being configured and disposed to dispense liquid beverage material into beverage bottles to be filled; at least one liquid reservoir being configured to hold a supply of liquid beverage material; at least one supply line being configured and disposed to connect said at least one liquid reservoir to said beverage bottle filling machine to supply liquid beverage material to said beverage bottle filling machine; a first star wheel structure being configured and disposed to move beverage bottles into said beverage bottle filling machine; and a second star wheel structure being configured and disposed to move beverage bottles out of said beverage bottle filling machine; a rotary beverage bottle closing machine being configured and disposed to close tops of filled beverage bottles; a second conveyor arrangement being configured and disposed to convey filled beverage bottles from said beverage bottle filling machine to said beverage bottle closing machine; said beverage bottle closing machine comprising: a rotor; a rotatable vertical machine column; said rotor being connected to said vertical machine column to permit rotation of said rotor about said vertical machine column; a plurality of closing devices being disposed on the periphery of said rotor; each of said plurality of closing devices being configured and disposed to place closures on filled beverage bottles; each of said plurality of closing devices comprising a container carrier being configured and disposed to receive and hold filled beverage bottles; a first star wheel structure being configured and disposed to move filled beverage bottles into said beverage bottle closing machine; and a second star wheel structure being configured and disposed to move filled, closed beverage bottles out of said beverage bottle closing machine; a beverage bottle packaging machine being configured and disposed to package filled, closed beverage bottles; a third conveyor arrangement being configured and disposed to convey filled, closed beverage bottles from said beverage bottle closing machine to said beverage bottle packaging machine; and said beverage bottle packaging machine comprising: a separating and grouping arrangement being configured and disposed to separate and group beverage bottles into groups and place the groups on trays; a wrapping device being configured and disposed to wrap groups of beverage bottles to secure the groups to their corresponding trays; a hole-making device being configured and disposed to make holes in the wrap corresponding to holes in a tray of the wrapped group of beverage bottles; and a stacking arrangement being configured and disposed to stack wrapped groups of beverage bottles by placing one stack on top the other, wherein an upper portion of the beverage bottles of a lower group of beverage bottles are disposed through the holes in the wrap and the tray of an upper group of beverage bottles and in a space formed by a bottom of a corresponding beverage bottle of the upper group of beverage bottles.

The components disclosed in the various publications, disclosed or incorporated by reference herein, may possibly be used in possible embodiments of the present application, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" U.S. Pat. No. 6,971,219 entitled "Beverage bottling plant for filling bottles with a liquid beverage filling material and a labelling station for labelling filled bottles and other containers;" U.S. Pat. No. 6,973,767, entitled "Beverage bottling plant and a conveyor arrangement for transporting packages;"U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

The appended drawings in their entirety, including all dimensions, proportions and/or shapes in at least one embodiment of the present application, are accurate and are hereby included by reference into this specification.

Some examples of bottling and container handling systems and components thereof which may possibly be utilized or adapted for use in at least one possible embodiment, may possibly be found in the following U.S. patent applications Ser. No. 10/723,451, filed on Nov. 26, 2003, having, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" U.S. patent application Ser. No. 10/739,895, filed on Dec. 18, 2003, having, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" U.S. patent application Ser. No. 10/865,240, filed on Jun. 10, 2004, having, Entitled "A Beverage Bottling Plant for Filling Bottles with a Liquid Beverage Filling Material, a Beverage Container Filling Machine, and a Beverage Container Closing Machine;" U.S. patent application Ser. No. 10/883,591, filed on Jul. 1, 2004, having, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" U.S. patent application Ser. No. 10/930,678, filed on Aug. 31, 2004, having, entitled "A Beverage Bottling Plant for Filling Bottles with a Liquid Beverage Filling Material, a Container Filling Plant Container Filling Machine, and a Filter Apparatus for Filtering a Liquid Beverage;" U.S. patent application Ser. No. 10/931,817, filed on Sep. 1, 2004, having, entitled "A Beverage Bottling Plant for Filling Bottles with a Liquid Beverage Filling Material, Having an Apparatus for Exchanging Operating Units Disposed at Rotating Container Handling Machines;" U.S. patent application Ser. No. 10/954,012, filed on Sep. 29, 2004, having; U.S. patent application Ser. No. 10/952,706, having; U.S. patent application Ser. No. 10/962,183, filed on Oct. 8, 2004, having; U.S. patent application Ser. No. 10/967,016, filed on Oct. 15, 2004, having; U.S. patent application Ser. No. 10/982,706, filed on Nov. 5, 2004, having; U.S. patent application Ser. No. 10/982,694, having; U.S. patent application Ser. No. 10/982,710, having; U.S. patent application Ser. No. 10/984,677, filed on Nov. 9, 2004, having; U.S. patent application Ser. No. 10/985,640, filed on Nov. 10, 2004, having; U.S. patent application Ser. No. 11/004,663, filed on Dec. 3, 2004, having; U.S. patent application Ser. No. 11/009,551, filed on Dec. 10, 2004, having; U.S. patent application Ser. No. 11/012,859, filed on Dec. 15, 2004, having; U.S. patent application Ser. No. 11/014,673, filed on Dec. 16, 2004, having; U.S. patent application Ser. No. 11/016,364, filed on Dec. 17, 2004, having; and U.S. patent application Ser. No. 11/016,363, having.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

All, or substantially all, of the components and methods of the various embodiments may be used with at least one embodiment or all of the embodiments, if more than one embodiment is described herein.

Some examples of a method or apparatus for hole cutting punching that may possibly be utilized or adapted for use in at least one possible embodiment may possibly be found in the following U.S. Pat. No. 4,759,246, entitled "Tumbling Hole Punch and Method for Punching Holes into a Moving Web Material"; U.S. Pat. No. 5,140,133, entitled "Electrical Impulse Hot Hole Punch for Making a Tear-Resistant Hole in Thermoplastic Film"; U.S. Pat. No. 4,653,372, entitled "Self-Sharpening Hole Punch for Plastic Bags"; and U.S. Pat. No. 6,148,710, entitled "Slitter-Punch with Quick Adaptor".

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of shrink wrapping machines or machines for wrapping items in plastic film which may possibly be utilized or adapted for use in at least one possible embodiment may possibly be found in the following U.S. Pat. No. 6,826,893, entitled "Apparatus for wrapping products with plastic film;" U.S. Pat. No. 6,739,115, entitled "Equipment for wrapping groups of products in plastic film;" U.S. Pat. No. 5,878,555, entitled "Apparatus for wrapping articles in plastic film;" U.S. Pat. No. 5,787,691, entitled "Apparatus for wrapping articles in plastic film;" U.S. Pat. No. 5,519,983, entitled "Shrink wrap packaging system with an ultrasonic side sealer;" U.S. Pat. No. 4,956,963, entitled "Method of sealing a shrink wrap package;" U.S. Pat. No. 4,873,814, entitled "Method of making a shrink wrap package;" U.S. Pat. No. 4,214,419, entitled "Collating and shrink wrap packaging apparatus;" U.S. Pat. No. 6,484,475, entitled "Modular packaging machine;" U.S. Pat. No. 4,694,633, entitled "Film wrapping machine;" U.S. Pat. No. 4,118,916, entitled "Thermoplastic wrapping machine;" U.S. Pat. No. 4,118,916, entitled "Thermoplastic wrapping machine;" U.S. Pat. No. 5,371,999, entitled "Shrink film wrapping machine;" U.S. Pat. No. 4,748,795, entitled "Film wrapping machine;" and U.S. Pat. No. 5,115,620, entitled "Wrapping machine."

All of the patents, patent applications and publications recited herein, and in the Declaration attached hereto, are hereby incorporated by reference as if set forth in their entirety herein.

Some examples of shrink film that may possibly be utilized or adapted for use in at least one possible embodiment are as follows: Pyramid 1000 Polyolefin Shrink Film and Pelson 44-PVC, possibly available through or manufactured by Quality Films Inc., located at 401 Park Avenue, Brooklyn, N.Y., 11205, U.S.A.; and Uline PVC, Reynolds PVC Rolls, Cryovac, Uline Polyolefin, or Heavy Duty Bundling shrink films, possibly available through or manufactured by Uline, located at 2105 South Lakeside Drive, Waukegan, Ill., 60085, U.S.A.

Some examples of shrink wrappers that may possibly be utilized or adapted for use in at least one possible embodiment are as follows: a High Speed Shrink Wrapper, possibly available through or manufactured by Aqua Technology Water Stores, located in San Jose, Sunnyvale, and Pismo Beach, Calif., U.S.A.; Weldotron Model 1611 and Weldotron 7141, possibly available through or manufactured by Weldotron 2000, Inc., located at 8211 Manchester Pike, Murfreesboro, Tenn., 37127, U.S.A.; and the Innopack PRIMUS SP 35 Shrinkpacker, possibly available through or manufactured by KHS Maschinen- und Anglagenbau AG, KHS Kisters Packaging Technology Plant, located at Boschstrasse 1-3, D-47533 Kleve, Germany.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of heat tunnels that may possibly be utilized or adapted for use in at least one possible embodiment are as follows: Weldotron Model 1611 and Weldotron 7141, available through or manufactured by Weldotron 2000, Inc., located at 8211 Manchester Pike, Murfreesboro, Tenn., 37127, U.S.A.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 10 2006 003 338.8, filed on Jan. 23, 2006, having inventors Christoph KOSTER, Josef DÜPPER, Alexander BRÜKER, Reinhard WILZECK, and Michael JÖRISSEN, and DE-OS 10 2006 003 338.8 and DE-PS 10 2006 003 338.8, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the present application described herein above in the context of the preferred embodiments are not to be taken as limiting the embodiments of the present application to all of the provided details thereof, since modifications and variations thereof may be made without departing from the spirit and scope of the embodiments of the present application.

AT LEAST PARTIAL NOMENCLATURE

1 Container
2 Container bottom
2.1 Empty space
3 Container mouth
4 Packaging unit
5 Tray
6 Tray bottom
7 Tray edge
8 Shrunk shrink wrap
**8*a*** Strip-format film material
**8*b*** Packaging length of shrink wrap
9 Tray opening
10 Film opening
11 Film residue
12 Stack of packaging units
13 Edge or flange
14 Supply roll
15 Perforation station
16 Cutting station
17 Packaging machine
18 Perforation and feed unit
19 Tool carrier
20 Geared motor
21 Cam
23 Cutting or punching tool
24 Repeat adjusting mechanism
25 Conveyor line
BA Container axis
A, B Transport direction

What is claimed is:

1. A method of manufacturing and stacking packaging units with increased stability, said method comprising the steps of:

providing a first tray having a bottom with a plurality of openings therein;

moving a first plurality of containers corresponding to said first tray openings onto said first tray, which containers each have a diameter greater than the diameter of its corresponding first tray opening, and which containers each have a depression in the bottom thereof;

removing a first piece of shrink wrap from a supply of shrink wrap film material;

wrapping said first tray and said first plurality of containers thereon in said first piece of shrink wrap, which said first piece of shrink wrap has a plurality of openings therein corresponding to said first tray openings, while aligning said first piece of shrink wrap openings with said first tray openings;

shrinking and tightening said first piece of shrink wrap to firmly hold said first tray and said first plurality of containers together to form a first packaging unit;

providing a second tray having a bottom with a plurality of openings therein;

moving a second plurality of containers corresponding to said second tray openings onto said second tray, which containers each have a diameter greater than the diameter of its corresponding second tray opening, and which containers each have a depression in the bottom thereof;

removing a second piece of shrink wrap from a supply of shrink wrap film material;

wrapping said second tray and said second plurality of containers thereon in said second piece of shrink wrap, which said second piece of shrink wrap has a plurality of openings therein corresponding to said second tray openings, while aligning said second piece of shrink wrap openings with said second tray openings;

shrinking and tightening said second piece of shrink wrap to firmly hold said second tray and said second plurality of containers together to form a second packaging unit; and stacking said second packaging unit on said first packaging unit by inserting at least a top portion of each of said first plurality of containers through a corresponding one of said second piece of shrink wrap openings, and then through a corresponding one of said second tray openings, and then into the depression in a corresponding one of said second plurality of containers, and thus forming a stabilized stack of packaging units.

2. The method according to claim 1, wherein:

said step of removing a first or second piece of shrink wrap from a supply of shrink wrap film material comprises:

unrolling a portion of a roll of shrink wrap film material;

making said shrink wrap openings by one of: punching, mechanically cutting, and laser cutting portions of said shrink wrap film material to completely remove the cut or punched-out portions from said shrink wrap film material; and cutting said first or second piece of shrink wrap from said roll of shrink wrap film material;

said step of moving a first plurality of containers onto said first tray comprises arranging the containers on the tray in three rows of three containers each, which first tray is plate-shaped and has four sides extending perpendicularly from the perimeter of said bottom;

said step of wrapping said first tray and said first plurality of containers thereon comprises wrapping said first tray and said first plurality of containers thereon in said first piece of shrink wrap, which said first piece of shrink wrap has a second plurality of openings therein corresponding to said first plurality of containers, while aligning each of said second plurality of shrink wrap openings with a corresponding container and inserting an upper portion of the corresponding container therethrough;

said step of moving a second plurality of containers onto said second tray comprises arranging the containers on the tray in three rows of three containers each, which second tray is plate-shaped and has four sides extending perpendicularly from the perimeter of said bottom;

said step of wrapping said second tray and said second plurality of containers thereon comprises wrapping said second tray and said second plurality of containers thereon in said second piece of shrink wrap, which said second piece of shrink wrap has a second plurality of openings therein corresponding to said second plurality of containers, while aligning each of said second plurality of shrink wrap openings with a corresponding container and inserting an upper portion of the corresponding container therethrough; and said step of stacking further comprises at least one of (A) and (B):

(A) contacting a top surface of each of said first plurality of containers with a bottom surface of a corresponding one of said second plurality of containers to support said first packaging unit on said second packaging unit; and (B) contacting at least a portion of the areas of said first tray surrounding said tray openings with said second plurality of containers to support said first packaging unit on said second packaging unit.

3. The method according to claim 1, wherein:

said step of removing a first or second piece of shrink wrap from a supply of shrink wrap film material comprises:

unrolling a portion of a roll of shrink wrap film material;

making said shrink wrap openings by one of: partly punching, partly mechanically cutting, and partly laser cutting portions of said shrink wrap film material to partly remove the cut or punched-out portions from said shrink wrap film material; and cutting said first or second piece of shrink wrap from said roll of shrink wrap film material;

said method further comprises moving the partially removed portions of said shrink wrap film material to one side of their corresponding openings and against the surrounding shrink wrap film material using at least one of: moving devices, guide surfaces, and air current;

said step of moving a first plurality of containers onto said first tray comprises arranging the containers on the tray in three rows of three containers each, which first tray is plate-shaped and has four sides extending perpendicularly from the perimeter of said bottom;

said step of wrapping said first tray and said first plurality of containers thereon comprises wrapping said first tray and said first plurality of containers thereon in said first piece of shrink wrap, which said first piece of shrink wrap has a second plurality of openings therein corresponding to said first plurality of containers, while aligning each of said second plurality of shrink wrap openings with a corresponding container and inserting an upper portion of the corresponding container therethrough;

said step of moving a second plurality of containers onto said second tray comprises arranging the containers on the tray in three rows of three containers each, which second tray is plate-shaped and has four sides extending perpendicularly from the perimeter of said bottom;

said step of wrapping said second tray and said second plurality of containers thereon comprises wrapping said second tray and said second plurality of containers thereon in said second piece of shrink wrap, which said second piece of shrink wrap has a second plurality of openings therein corresponding to said second plurality of containers, while aligning each of said second plurality of shrink wrap openings with a corresponding container and inserting an upper portion of the corresponding container therethrough; and said step of stacking further comprises at least one of (A) and (B):

(A) contacting a top surface of each of said first plurality of containers with a bottom surface of a corresponding one of said second plurality of containers to support said first packaging unit on said second packaging unit; and (B) contacting at least a portion of the areas of said first tray surrounding said tray openings with said second plurality of containers to support said first packaging unit on said second packaging unit.

4. The method according to claim 3, wherein:

said step of removing a first or second piece of wrap from a supply of wrap material comprises removing a first or second piece of shrink wrap material; and said step of moving a first or second plurality of containers comprises moving a first or second plurality of bottles.

5. A method of manufacturing and stacking packaging units with increased stability, said method comprising the steps of:

providing a first tray having a bottom with a plurality of openings therein;

moving a first plurality of containers corresponding to said first tray openings onto said first tray, which containers each have a diameter greater than the diameter of its corresponding first tray opening, and which containers each have a top surface and a bottom surface;

removing a first piece of wrap from a supply of wrap material;

wrapping at least a portion of said first tray and said first plurality of containers thereon in said first piece of wrap to firmly hold said first tray and said first plurality of containers together to form a first packaging unit;

providing a second tray having a bottom with a plurality of openings therein;

moving a second plurality of containers corresponding to said second tray openings onto said second tray, which containers each have a diameter greater than the diameter of its corresponding first tray opening, and which containers each have a top surface and a bottom surface;

removing a second piece of wrap from a supply of wrap material;

wrapping at least a portion of said second tray and said second plurality of containers thereon in said second piece of wrap to firmly hold said second tray and said second plurality of containers together to form a second packaging unit;

stacking said second packaging unit on said first packaging unit by inserting the top surface of each of said first plurality of containers through a corresponding one of said second tray openings and engaging the bottom surface of a corresponding one of said second plurality of containers, which corresponding top and bottom surfaces are configured to engage with one another, and thus forming a stabilized stack of packaging units.

6. The method according to claim 5, wherein:

said step of removing a first or second piece of wrap from a supply of wrap material comprises:

unrolling a portion of a roll of wrap material; and cutting said first or second piece of wrap from said roll of wrap material;

said step of moving a first plurality of containers onto said first tray comprises arranging the containers on the tray in three rows of three containers each, which first tray is plate-shaped and has four sides extending perpendicularly from the perimeter of said bottom;

said step of wrapping said first tray and said first plurality of containers thereon comprises wrapping said first tray and said first plurality of containers thereon in said first piece of wrap, which said first piece of wrap has a plurality of openings therein corresponding to said first plurality of containers, while aligning each of said plurality of wrap openings with a corresponding container and inserting an upper portion of the corresponding container therethrough;

said step of moving a second plurality of containers onto said second tray comprises arranging the containers on the tray in three rows of three containers each, which second tray is plate-shaped and has four sides extending perpendicularly from the perimeter of said bottom; and said step of wrapping said second tray and said second plurality of containers thereon comprises wrapping said second tray and said second plurality of containers thereon in said second piece of wrap, which said second piece of wrap has a plurality of openings therein corresponding to said second plurality of containers, while aligning each of said plurality of wrap openings with a corresponding container and inserting an upper portion of the corresponding container therethrough.

7. The method according to claim 6, wherein:

said step of removing a first or second piece of wrap from a supply of wrap material comprises removing a first or second piece of shrink wrap material; and said step of moving a first or second plurality of containers comprises moving a first or second plurality of bottles.

* * * * *